US008113208B2

(12) United States Patent
Chaisson et al.

(10) Patent No.: US 8,113,208 B2
(45) Date of Patent: Feb. 14, 2012

(54) APPARATUS AND METHOD FOR PROTECTING EARLOBES OF ATHLETES

(75) Inventors: Barbara Ann Chaisson, Pembroke, MA (US); Alye Terese Chaisson, Pembroke, MA (US)

(73) Assignee: Barbara A. Chaisson, Pembroke, MA (US)

( * ) Notice: Subject to any disclaimer, the term of this patent is extended or adjusted under 35 U.S.C. 154(b) by 393 days.

(21) Appl. No.: 12/402,203

(22) Filed: Mar. 11, 2009

(65) Prior Publication Data

US 2009/0229619 A1 Sep. 17, 2009

Related U.S. Application Data

(60) Provisional application No. 61/069,012, filed on Mar. 11, 2008.

(51) Int. Cl.
*A61F 11/00* (2006.01)

(52) U.S. Cl. ..... 128/864

(58) Field of Classification Search ..... 128/864, 128/866, 857; 602/41–42
See application file for complete search history.

(56) References Cited

U.S. PATENT DOCUMENTS

| | | | | |
|---|---|---|---|---|
| 4,643,181 | A * | 2/1987 | Brown | 604/307 |
| 6,003,333 | A * | 12/1999 | Stevens | 63/12 |
| 2006/0184184 | A1 * | 8/2006 | Sorribes | 606/151 |

* cited by examiner

*Primary Examiner* — Patricia Bianco
*Assistant Examiner* — Camtu Nguyen
(74) *Attorney, Agent, or Firm* — Finch & Maloney PLLC

(57) ABSTRACT

An earlobe protector is described. The earlobe protector may be adhered to an athlete's ear when the athlete is wearing an earring. The protector can allow the athlete to participate in contact sports without removing the earring.

6 Claims, 2 Drawing Sheets

APPARATUS AND METHOD FOR PROTECTING EARLOBES OF ATHLETES

RELATED APPLICATIONS

This application claims priority to, and benefit of, U.S. Provisional Patent Application No. 61/069,012, titled DISPOSABLE FOAM PIERCED EARLOBE PROTECTORS FOR SPORTS, filed Mar. 11, 2008, the contents of which are incorporated herein by reference.

BACKGROUND

1. Field of Invention

The invention relates to methods and devices for protecting ears and, in particular, to devices for protecting pierced earlobes and adjacent skin from physical injury during sporting events.

2. Discussion of Related Art

Participation in youth sports generates a host of safety issues that are often addressed by rules, policies and equipment changes. In particular, youth team sports present a variety of hazards due to the close and sometimes violent contact that can occur between players and/or objects. These sports include, for example, soccer, lacrosse, field hockey, hockey, softball and basketball. The wearing of earrings in a pierced ear during a sporting event can result in injury when the earring is snagged on the player's or another player's equipment. In many cases a referee or coach may require that the player removes her earring prior to being allowed to play. This can present a difficult decision for some athletes with newly pierced ears because they have been told that if they remove the earrings from the piercing that the hole will heal up. This can lead to players choosing not to play rather than to remove their earrings. As a result, some referees will allow players to participate if they cover the ear lobe with athletic tape.

SUMMARY

In one aspect an earlobe protector is provided, the earlobe detector comprising an adhesive layer for adhering to the outside surface and the inside surface of an earlobe, a cushioning layer adjacent the adhesive layer, the cushioning layer constructed and arranged to surround both a first end and an opposed second end of an earring retained in an earlobe, and a decorative outer layer adjacent the foam layer wherein the decorative layer is displayed upon adhering the earlobe protector to the earlobe.

In another aspect, a method is provided for protecting an earlobe and head when the earlobe includes an earring, the method comprising pressing a first portion of an adhesive cushioning protector over an earring suspended in an earlobe, folding a second portion of the cushioning protector over the earlobe to cover the opposing end of the earring, and affixing the first and second portions of the cushioning protector to the outside and inside surface of the earlobe wherein the earring does not protrude from the surface of the cushioning protector.

The subject matter of this application may involve, in some cases, interrelated products, alternative solutions to a particular problem, and/or a plurality of different uses of a single system or article.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein.

DETAILED DESCRIPTION

Figure 1:
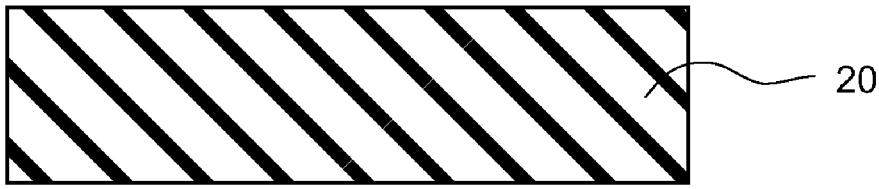
FIG. 1 provides a plan view of the decorative layer of one embodiment of an earlobe protector.

In one aspect, a device is provided for protecting earlobes that prevents injury that might otherwise occur when an athlete is wearing earrings. The device can be flexible and may include a first portion that covers the back of an earring and a second portion that covers and protects the front of the earring. It can include an adhesive layer for affixing the device to the earlobe. A release sheet layer may protect the adhesive layer prior to use. A thicker, soft layer that can be made from expanded foam can surround the front and/or back of the earring to smooth the contours of the earring and prevent it from getting caught on an opponent's body, clothing or equipment. This layer can also protect the ear, neck and head portions that may be cut by an exposed earring if the player is struck, for example, by a soccer ball. An outer layer, that may be the most visible, can be a decorative layer and may include a particular color, a design such as a team logo, or, for example, information such as the player's number.

In another aspect, a method of protecting an earlobe is provided. The method can include affixing a compressible foam layer around both the front and back of an earlobe that includes an earring. The foam layer can be compressed around the earlobe to hide the earring and eliminate any exposed sharp edges that may be susceptible to snagging. The foam layer may be covered by a decorative layer that is visible after the protector is applied. The foam layer may smooth out the contours of the earring so that it is not caught on other players' bodies, clothing, nets, shoes, equipment, etc. In this way, studs or other earrings may be retained in the ear and the player can safely participate in the sport.

For safety reasons, youth athletes are often required to remove earrings from their ears prior to participating in a game or practice. While this may not be a problem for those with well-healed piercings, newly pierced ears may close up if earrings (often studs) are removed for any length of time. In addition, re-insertion of studs in newly pierced earlobes can be difficult and/or painful because the piercing is not yet well-defined. Furthermore, additional handling of the earring and insertion and removal of the earring from the ear can results in bleeding and/or infection. This means that youth athletes are often faced with the difficult decision of whether to risk the hazards of removal and re-insertion of the earrings in order to be able to participate in the game.

Some referees may refuse to allow participation of anyone wearing earrings. Others may allow the athlete to participate if the earring is covered by, for example, a piece of athletic tape. However, it has been found that this treatment can often be ineffective. For example because the tape is thin, the contours of the earring often are evident through the tape, leaving edges exposed that can still get caught on passing objects. In addition, the tape is particularly sticky and difficult to remove. If conventional medical adhesive bandages are used, similar earring contour issues develop. Medical adhesive bandages may have a thicker, padded portion that is centrally located on the bandage. When applied to the earlobe, the padded middle portion covers the bottom of the earlobe. The critical area, near the front and back of the pierced region, is typically only covered by the thin portion of the adhesive bandage. This thin portion of the adhesive bandage also is prevented from adhering to the earlobe because the earring protrudes outwardly, preventing surrounding portions of the bandage from making good contact with the athlete's ear. In addition, when struck by a ball or other object, the force of the ball may still be transmitted to the earring, forcing the back of the earring into the skin that covers the skull adjacent the earlobe. Furthermore, it has also been observed that athletes can become self-conscious wearing "band-aids" on their ears.

Figure 2:
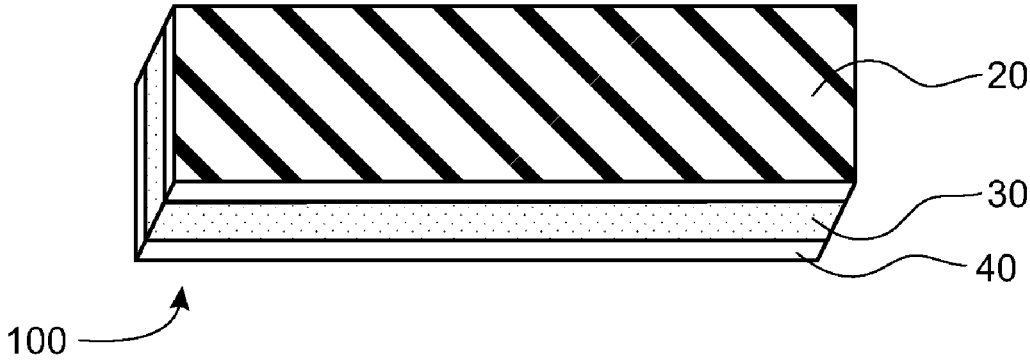
FIG. 2 provides an isometric view of the embodiment of FIG. 1.
Figure 3:
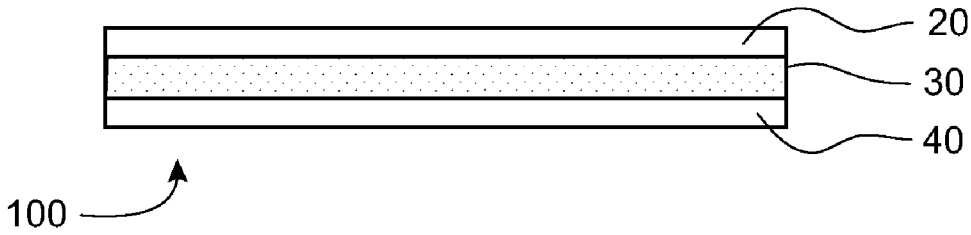
FIG. 3 provides a cross-sectional view of the embodiment of FIG. 1.
Figure 4:
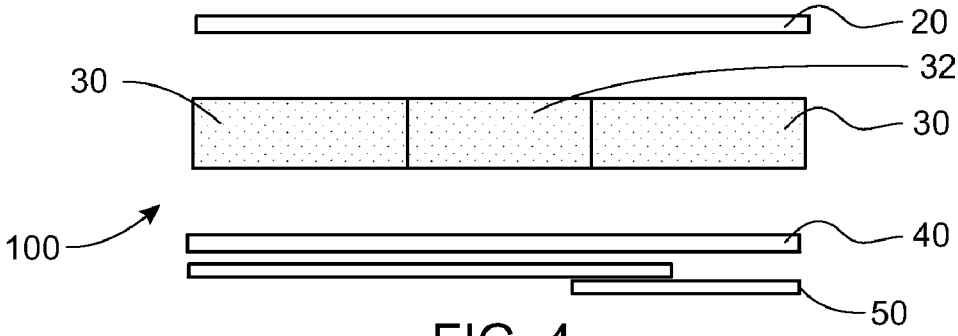
FIG. 4 provides an exploded cross sectional view of another embodiment of an earlobe protector.

In one set of embodiments, illustrated in FIGS. 1-6, ear protector 100 can be either disposable or re-usable. The protector 100 may be sized appropriately to protect the front and back sides of an earlobe. For example, in some embodiments the protector may have a length greater than about 1 inch, greater than about 1.5 inch or greater than about 2 inches. In some embodiments it may have a width of more than 0.25 inch, more than 0.5 and inch, or more than 0.75 inch. The corners may be square or may include a radius. The ear protector illustrated in FIGS. 1-3 is a three-layer embodiment that includes adhesive (40), cushioning (30) and decorative layers (20). FIG. 1 provides a top view of the earlobe protector. Outer layer 20 of protector 100 is the layer that is most exposed after the protector is adhered to an earlobe, and layer 20 therefore may include a decorative, informative or artistic look. This may help to hide that the ear protector is a safety item and make it appear more like jewelry for the ear. In some embodiments the layer may be printed with, for example, soccer balls, lacrosse sticks, field hockey sticks or softball gloves. Outer layer 20 may also be brightly or uniquely colored or patterned. Other printed indicia may include team mascots or a player's nickname or the player's number. Outer layer 20 may be of any appropriate material such as, for example, nylon, polyester and/or vinyl. Preferably, the material can be printed on and does not appear to be a bandage when it is applied to the ear. In one embodiment, outer layer 20 is formed from pre-printed ribbon, such as hair ribbon or gift ribbon and can even be matched to ribbon worn in the player's hair.

Cushioning layer 30 is illustrated in FIGS. 2-5. In some embodiments, cushioning layer 30 may be integral to one of the adjacent layers. Cushioning layer 30 may be the full length and width of protector 100 and may be of consistent or varied thickness across the protector. In some embodiments, central portion 32 of protector 100 may be void of cushioning material or the cushioning material may be thinner in this portion. This may allow for easier bending of protector 100 around the earlobe while still providing for adequate protection for the portion of the earlobe that includes the earring. Cushioning layer 30 may be a soft and compressible layer that can conform to the earring, for example, conforming to a stud 70 that passes through the earlobe (or other portion of the ear). Cushioning layer 30 may be easily compressed so that the contour of the earring is not visible through the protector after it has been applied. Additionally, this layer may be thick enough that when a player is hit in the ear, for instance by a soccer ball, cushioning layer 30 can provide enough protection so that the earring does pierce the player's skin against the skull and directly behind the back of the earring. The protection device can use cushioning layer 30 to distribute the force in this area so that the back of the earring does not cause injury. To accomplish this, the cushioning layer in the area of the earring back should be at least as thick as the portion of the earring that extends from the inside surface of the earlobe to the end of the (back of the) earring. In some embodiments, cushioning layer 30 may have a thickness greater than or equal to 1 mm, 2 mm, 3 mm, 5 mm or 7 mm. Cushioning layer 30 may be made of a natural or synthetic material. In some embodiments, the cushioning layer may be a gel that flows around the earring when the protector is applied to the earlobe. In other embodiments it may be a foam such as a natural rubber or synthetic polymer. Appropriate polymer foams include, for example, polystyrene, polyurethane and/or latex foam. Foams may be open or closed cell and may be of a low density so that the foam fits around the earring on the front and the back of the earlobe. For example the foam may have a density less than 4, less than 3, less than 2, or less than 1 $lb/ft^3$. The cushioning material may be breathable, meaning that it is pervious to water vapor. The cushioning material may also be non-allergenic and may include an antimicrobial agent.

Adhesive layer 40 may be similar to the pressure sensitive adhesive layer used in a medical bandage. Adhesive layer 40 may cover all, or part of, the cushioning portion of the protector. A central portion of the protector my be void of adhesive as this portion surrounds the bottom of the earlobe and is not required for adhering the protector to the ear. The adhesive should exhibit adequate tackiness so that it can adhere securely to an earlobe while still being easily removable after a game. The adhesive used may be water resistant so that the protector does not fall off if the player sweats or is playing in the rain. The adhesive may be coated directly onto the cushioning layer or may be a distinct layer that is then affixed to the cushioning layer. The adhesive may be non-allergenic and should not leave a residue or tarnish the earring with which it will be in contact. In some embodiments, appropriate adhesives may include, for example, acrylic, latex, silicone and spirit gum. In another set of embodiments adhesive layer 40 may include an antimicrobial agent to aid in preventing the infection of recently pierced ears. Antimicrobial agents are known to those of skill in the art and may include, for example, alcohols, silver-based antimicrobials, chlorine dioxide releasing agents and antibacterial creams. These antimicrobial agents may help to prevent infection of the pierced ear that might otherwise occur in the competitive environment. Adhesive layer 40 may be breathable so that moisture can pass from the earlobe outwardly through the protector. Release layer 50 may cover and protect the adhesive layer until the protector is to be applied. Release layer 50 may include a silicone coating and may be of a material similar to that used in medical adhesive bandages.

Figure 5:
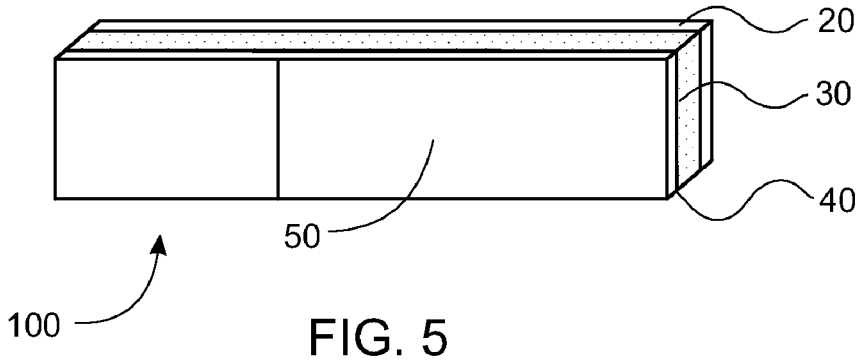
FIG. 5 provides an isometric view of the embodiment shown in FIG. 4.
Figure 6:
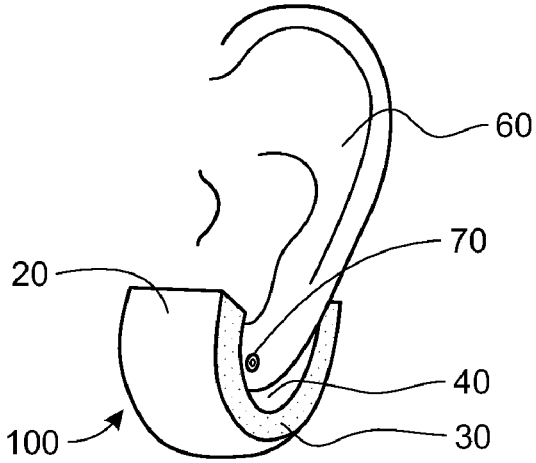
FIG. 6 illustrates the embodiment of FIG. 5 being placed on an earlobe.

In another embodiment, a method of protecting an ear 60 includes placing an earlobe protector 100, as described above, onto the earlobe of an athlete. As illustrated in FIG. 6, an earlobe protector may be folded into two portions so that one portion covers the outside surface of the earlobe (facing away from the head) and another portion covers the inside surface of the earlobe (facing toward the head). Prior to use, the earlobe protector may be substantially flat and linear as shown in FIG. 5. After removal of the release layer, one end of the protector may be affixed to either the outside or the inside of the earlobe. The opposing half of the protector may then be folded about 180°, as shown, so that it may be affixed to the opposing surface of the earlobe. The cushioning layer 30 allows the protector to be pressed onto the earlobe to securely affix the pressure sensitive adhesive layer 40 to both the inside and outside surfaces of the earlobe. The portion of the earring extending through the earlobe is absorbed into the soft cushioning layer, allowing the surrounding area to be contacted with the earlobe and to provide adequate adhesion of the protector to the earlobe. This helps to secure the earring in place while providing an outwardly facing smooth surface that is not susceptible to catching on other players, objects and clothing. At the completion of the game, the protector can be easily removed by the player, a parent or a coach. In most cases, the protector is disposed of and a fresh one is applied for the next game. Players may choose a protector that includes an attractive or useful outer layer 20. The outer layer 20 may be an artistic design or may include useful information, such as the player's number. Earlobe protectors may be provided in pairs or in packages containing multiple pairs.

When worn during sports activity, the earlobe protectors can help to protect the user from a variety of impacts. The protectors can prevent earrings from snagging on passing clothing and equipment. They can also prevent the back of the earring from being driven into the player's head when the ear is struck by a player, a ball, or another object. The protector may be worn with or without a helmet. When worn with a helmet, the protector provides additional protection that cannot be obtained with a helmet alone because a helmet does not provide any cushioning between the earring and the skull. Without an earlobe protector, an earring can still be driven into the player's skin when the helmet is struck by a ball, puck or other object.

While several embodiments of the present invention have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present invention. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present invention is/are used. Those skilled in the art will recognize, or be able to ascertain using no more than routine experimentation, many equivalents to the specific embodiments of the invention described herein. It is, therefore, to be understood that the foregoing embodiments are presented by way of example only and that, within the scope of the appended claims and equivalents thereto, the invention may be practiced otherwise than as specifically described and claimed. The present invention is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present invention.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

All references, patents and patent applications and publications that are cited or referred to in this application are incorporated in their entirety herein by reference.

What is claimed is:

1. A method of protecting an earlobe when the earlobe includes an earring, the method comprising:

pressing a first portion of an adhesive cushioning protector over an earring suspended in an earlobe;

folding a second portion of the adhesive cushioning protector over the earlobe to cover the opposing end of the earring; and affixing the first and second portions of the adhesive cushioning protector to the outside and inside surface of the earlobe wherein the earring does not protrude from the surface of the adhesive cushioning protector.

2. The method of claim 1 further comprising forming a smooth outer surface on the earlobe that renders the earlobe less susceptible to catching on passing objects.

3. The method of claim 1 further comprising removing a release sheet from the adhesive cushioning protector prior to affixing the first and second portions of the adhesive cushioning protector to the earlobe.

4. The method of claim 1 further comprising treating the earlobe and/or the adhesive cushioning protector with an antimicrobial agent prior to affixing the first and second portions of the adhesive cushioning protector to the ear.

5. The method of claim 1 wherein the inside surface of the earlobe is covered by a the adhesive cushioning protector having a thickness at least as great as the length of the portion of the earring that protrudes inwardly from the inner surface of the earlobe toward the skull.

6. The method of claim 1 wherein the contours of the earring are not visible through the adhesive cushioning protector.

* * * * *